US005299708A

United States Patent [19]

Hallock, III

[11] Patent Number: 5,299,708

[45] Date of Patent: Apr. 5, 1994

[54] GARBAGE PAIL

[76] Inventor: Orrin S. Hallock, III, 33 Roberts Rd., Cambridge, Mass. 02138

[21] Appl. No.: 99,124

[22] Filed: Jul. 29, 1993

[51] Int. Cl.[5] ..... B65B 67/04; B65D 1/24

[52] U.S. Cl. ..... 220/404; 220/908

[58] Field of Search ..... 220/404, 908

[56] References Cited

U.S. PATENT DOCUMENTS

| | | | |
|---|---|---|---|
| 4,765,579 | 8/1988 | Robbins, III et al. | 220/404 |
| 4,867,328 | 9/1989 | McCarthy | 220/404 |
| 4,905,853 | 3/1990 | Strawder | 220/404 |
| 4,940,159 | 7/1990 | Callas et al. | 220/404 |
| 4,974,746 | 12/1990 | Dickinson | 220/404 |
| 5,005,727 | 4/1991 | Roth | 220/404 |

*Primary Examiner*—Joseph Man-Fu Moy

[57] ABSTRACT

The object of the present invention is to provide a garbage pail having a lid pivotly mounted on a lid mount structure, the lid mount structure having a liner space allowing a liner to be folded over the mouth of the container without obstructing the lid and vise versa, Said garbage pail comprised of an open mouth container (1) molded substaintally of a solid substance, said garbage pail having a lid (4.5) seating on the mouth thereof, pivotly secured to a lid mount structure (3) extending outward from the rear wall of the container, the lid mount structure is formed with a liner space (6) open at the top and sides allowing a plastic liner bag to be folded over the mouth of the container, the lid mount structure is formed with a rearwardly extending wall standoff (5).

1 Claim, 1 Drawing Sheet

GARBAGE PAIL

TECHNICAL FIELD

The present invention relates to domestic waste receptacles for the collection, containment and temporary storage of household rubbish and to commercial paper and plastic shopping bags.

BACKGROUND ART

In the present industrialized world it is possible to purchase a vast array of domestic garbage pails. Most household waste pails are used in conjunction with a disposable sanitary liner inserted to line the holding cavity of the container. Though most garbage pails are used inconjunction with disposable liners few are designed and constructed to hold the same open, and prevent refuse from getting between the liner and the inner walls of the container.

DISCLOSURE OF INVENTION

In accordance with the present present invention there is provided a garbage pail comprised of an open mouth container. The mouth of the holding cavity of the container has a four member inwardly folding perimeteral lip for holding open the mouths of paper shopping grocery inserted within the holding cavity open against the interior walls of the mouth of the container to prevent substances disposed within the container from getting outside the liner inbetween the liner and the container.

BRIEF DESCRIPTION OF DRAWINGS

The details of the present invention will be discussed in connection with the accompaning drawing, FIG. 1 which presents an exploded perspective view of a possible embodiment of the present invention, though let it be known that the scope of the invention is not so limited.

BEST MODE FOR CARRYING OUT THE INVENTION

Figure 1:
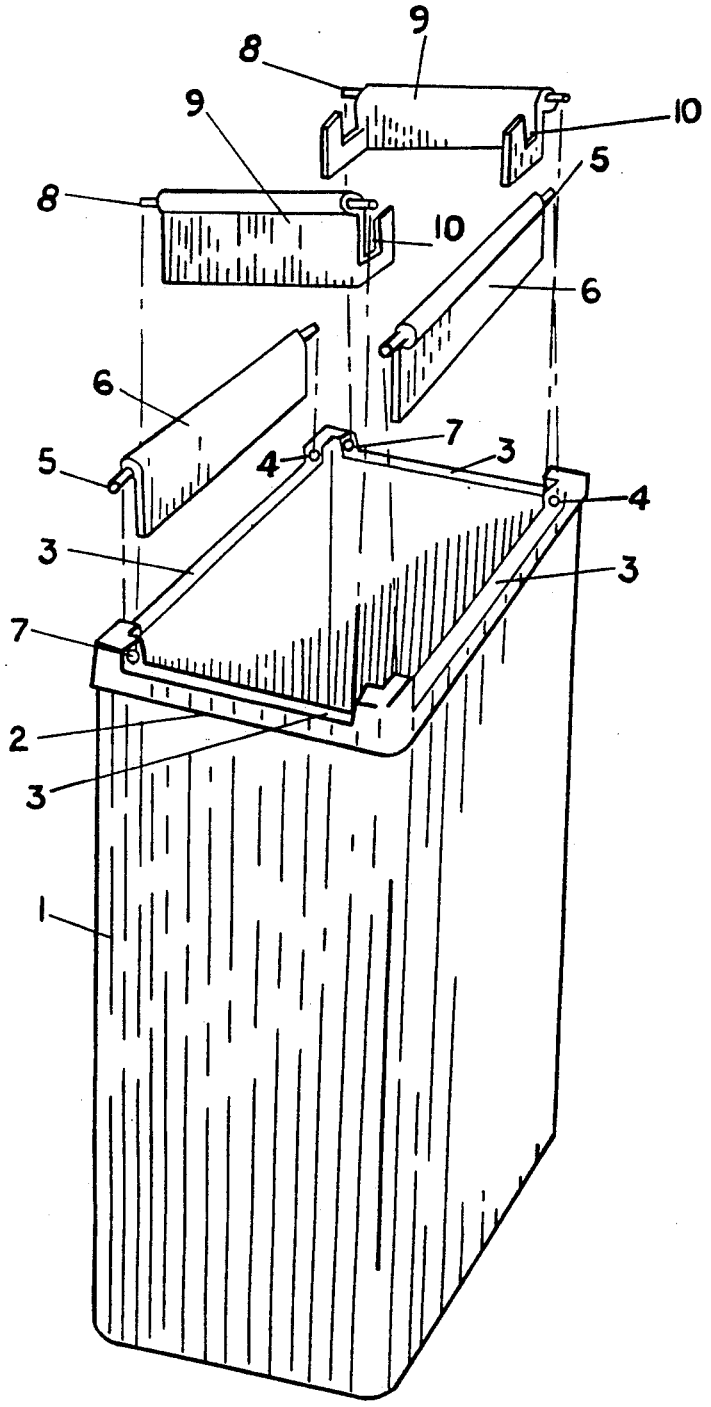

Referring now to the drawing FIG. 1 by reference characters there is shown an open mouth garbage pail 1 of molded plastic. The mouth of the container is molded with a downwardly extending collar 2 thereabout. The collar of the mouth of the container is molded with recessed shelf 3 along the widthwise and lengthwise ends. The opposing lengthwise defining walls of the recessed portions of the mouth of the container are formed with a perforation 4 each, for pivotly seating the integral hinge pins 5 molded at either end of the central length of a pair of liner holding flaps 6, and pivotly securing the liner holding flaps to the lengthwise ends of the mouth of the container. The opposing lateral defining walls of the recessed portions of the widthwise dimensions mouth of the container are formed with a perforation 7 each, for pivotly seating the integral hinge pins 8 molded at either end of the central length of a pair of liner holding C shaped members 9, and pivotly securing the C shaped liner holding members to the widthwise ends of the mouth of the container. When installing a paper or plastic shopping bag in the holding cavity of the container the lengthwise members are in folded first over the upper lip of the liner bag and the C shaped members are infolded secondly locking the lengthwise members in place, there sandwiching the upper perimeteral lip of a liner bag between the inner walls of the mouth of the container and the inwardly folding members of the liner holding lip. The right angled appendages of the C shaped folding members are formed with rectangular cutouts 10 open to the top directly abutting the angle of orientation for suspending the integral handled plastic shopping bags into the container to line the same with the upper lips of the bags sandwiched beneath the inwardly folding members of the liner holding lip.

The present invention possesses the advantage of providing a domestic garbage pail that will except common disposable paper grocery bag and integral handled plastic grocery bags as disposable liners therefor, and will hold the mouths thereof open against the interior walls of the container, thus preventing undesirable material from falling between the liner and the interior walls of the container.

I claim:

1. A garbage pail comprised of a base supporting upwardly extending walls, the upper portions of said walls defining a mouth, rearward portions of said walls having a lid support structure, said lid support structure having a lid pivotly secured thereto, said lid support structure holding said lid stationary in either a closed position covering said mouth or in an open position above said mouth, said lid support structure having at least one liner slot formed therein, open to the top and sides, extending downward significantly below the upper portions of said walls, said lid support structure having wall standoff means extending rearward beyond said lid, thereby providing a garbage pail where a liner can be folded over said mouth and the upper portions of said walls without becoming obstructed by said lid support structure or said lid, or pinched between said lid and said lid support structure, wherein the lid can freely pivot on the lid support structure with out obstruction by a rearward wall contacting the garbage pail, said standoff means further providing protection for retaining the lid operably on the garbage pail inevent the garbage pail is jostled into a rearward wall.

* * * * *

UNITED STATES PATENT AND TRADEMARK OFFICE

CERTIFICATE OF CORRECTION

PATENT NO. : 5,299,708

DATED : April 5, 1994

INVENTOR(S) : Hallock, III

It is certified that error appears in the above-indentified patent and that said Letters Patent is hereby corrected as shown below:

On the title page item (57) should read as follows:

Abstract:

An open mouth garbage pail (1) having a pair of inwardly folding liner holding flaps (6) movably supported by opposing walls of the mouth of the garbage pail, and a pair of inwardly folding C shaped flaps (9) movably supported by opposing walls of the garbage pail adjacent the inwardly folding liner holding flaps. The outward

UNITED STATES PATENT AND TRADEMARK OFFICE

CERTIFICATE OF CORRECTION

PATENT NO. : 5,299,708

DATED : April 5, 1994

INVENTOR(S) : Hallock, III

It is certified that error appears in the above-indentified patent and that said Letters Patent is hereby corrected as shown below:

extensions of the C shaped flaps are inwardly movable over the adjacent liner holding flaps locking them in place, for holding the mouths of disposable shopping bags placed in the garbage pail as liner bags open therebetween.

UNITED STATES PATENT AND TRADEMARK OFFICE

CERTIFICATE OF CORRECTION

PATENT NO. : 5,299,708
DATED : April 5, 1994
INVENTOR(S) : Hallock, III

It is certified that error appears in the above-indentified patent and that said Letters Patent is hereby corrected as shown below:

Claim 1 should read as follows:

1. A garbage pail formed of a solid substance, said garbage pail comprised of a base supporting upright walls, the upper portions of said walls defining a mouth, said mouth having liner holding means comprised of a pair of inwardly movable members supported by opposing walls of said mouth, and a pair of inwardly movable C shaped members supported by opposing walls of said mouth, said C shaped members having outward extensions at either end, said outward extensions inwardly movable over said inwardly movable members adjacent thereto,

UNITED STATES PATENT AND TRADEMARK OFFICE

CERTIFICATE OF CORRECTION

PATENT NO. : 5,299,708

DATED : April 5, 1994

INVENTOR(S) : Hallock, III

It is certified that error appears in the above-indentified patent and that said Letters Patent is hereby corrected as shown below:

locking said inwardly movable members in place, for holding open the mouths of shopping bags placed as liners within said garbage pail, between said liner holding means and said garbage pail, thereby providing a garbage pail that can utilize either paper or plastic shopping bags or both together, one inside the other as disposable liners therefor.

Signed and Sealed this

Ninth Day of January, 1996

*Attest:*

*Attesting Officer*

Bruce Lehman

BRUCE LEHMAN

*Commissioner of Patents and Trademarks*